US006827315B2

(12) United States Patent
Fierz et al.

(10) Patent No.: US 6,827,315 B2
(45) Date of Patent: Dec. 7, 2004

(54) METHOD AND SYSTEM FOR PREVENTING OVERFILLING OF A TRACK SYSTEM

(75) Inventors: Werner Fierz, Herrliberg (CH); Cristina Bertelli, Dietlikon (CH)

(73) Assignee: Siemens Schweiz AG, Zuerich (CH)

( * ) Notice: Subject to any disclaimer, the term of this patent is extended or adjusted under 35 U.S.C. 154(b) by 0 days.

(21) Appl. No.: 10/228,242

(22) Filed: Aug. 26, 2002

(65) Prior Publication Data

US 2003/0025043 A1 Feb. 6, 2003

Related U.S. Application Data

(63) Continuation of application No. PCT/EP01/01476, filed on Feb. 10, 2001.

(30) Foreign Application Priority Data

Feb. 25, 2000 (CH) ..... 2000 0373/00

(51) Int. Cl.[7] ..... A61L 21/00
(52) U.S. Cl. ..... 246/20
(58) Field of Search ..... 246/20, 21, 22, 246/27, 28 R, 122 C, 123, 124

(56) References Cited

U.S. PATENT DOCUMENTS 4,858,859 A * 8/1989 Apperson ..... 246/20
4,994,969 A * 2/1991 Petit ..... 701/19
5,072,900 A 12/1991 Malon
5,574,469 A 11/1996 Hsu
6,195,023 B1 * 2/2001 Walsh et al. ..... 340/988
6,470,244 B2 * 10/2002 Oguma et al. ..... 701/19

FOREIGN PATENT DOCUMENTS

WO WO 98/37432 8/1998
WO WO 99/52091 10/1999

* cited by examiner

*Primary Examiner*—S. Joseph Morano
*Assistant Examiner*—Robert J. McCarry, Jr.
(74) *Attorney, Agent, or Firm*—Laurence A. Greenberg; Werner H. Stemer; Ralph E. Locher

(57) ABSTRACT

The invention relates to a decision procedure in combinational logic which requires a computing time of n for determining the congestion of a railway track system. The railway track system supports n trains, each with a route length of m itineraries. Prior to setting a requested route segment for a given train, a query is performed to check train positions and whether the given train is allowed to travel on the track sectors to be used for the requested route segment, without causing a possibility that the track system may become congested. The processing steps can be reduced. a) verification of whether a train can reach the next immediate track sector of a route; b) verification for a two-train variation whether a reference position of the first train prevents the second train from traveling on its route; c) new dependencies are created using transitivity and for combinations of two trains, a verification is made whether a cogent sequence exists. Step c) is iterated until no new dependencies occur or no train can reach its destination.

10 Claims, 5 Drawing Sheets

METHOD AND SYSTEM FOR PREVENTING OVERFILLING OF A TRACK SYSTEM

CROSS-REFERENCE TO RELATED APPLICATION

This application is a continuation of copending International Application No. PCT/EP01/01476, filed Feb. 10, 2001, which designated the United States and which was not published in English.

BACKGROUND OF THE INVENTION

Field of the Invention

The present invention lies in the field of railborne track vehicle management. More specifically, the invention relates to a method and a system for preventing the overfilling of a track system which is divided into track sectors and which is modeled in a route level with routes and a signal tower level with route segments. The levels are connected in order to request the setting of a route segment and to signal train positions, and a train position is determined by a train identifier, which identifies a train, and a track sector.

The expedient and reliable setting up and release of route segments for track-bound vehicles, referred to below as trains, are brought about by train services using operative methods. The selection of the track for the formation of route segments is affected by real operating conditions in a variety of ways. Examples of this are: operational effects, the composition of trains and in particular their length, the failure of track sectors due to defects.

The safety devices, referred to below as signal towers, which are used in the setting-up process ensure that only route segments that cannot lead to the traveling trains being put at risk are set up. However, the signal towers do not prevent route segments being set up which can impede or block trains from traveling onward. In such a case the track system is overfilled. Overfilling can be eliminated only by moving a train in reverse. This gives rise to time-consuming maneuvers with corresponding undesirable consequences for the timetable and the commercial operations.

In modern operative operational control centers, powerful control systems are increasingly performing routine control operations of the train service. In a control system, a unique train identifier that is used once throughout the timetable and an associated individual route through the track system are programmed for each traveling train, the train identifier usually being recorded as a train number. The train control system detects, as part of the control system, the respective position of the train and automatically sets up the next route segment for the onward travel of the respective train. The stimulus for the setting up of the route segment is given by the traveling train itself. Its position is continuously registered in the control system. In this way, the sequence of the route segments that are set up is directly dependent on the current trains journey. When there are unfavorable chronological conditions, the setting up of routes can lead to blocking owing to overfilling. So that the advantages of automatic train control can be utilized in all situations, the train control system must be able to foresee possible blockages and not set up the corresponding route segments, or set them up after a delay.

Before a route segment is set up, i.e. before a setup request is output to a signal tower, the train control system must check the effects in terms of overfilling of the track system. FIG. 1 illustrates a route level I: a view of the train control system; and a switchgear level or signal tower level II: view of the signal tower equipment. So that the route segments continue to be set up in good time, it must be possible to make the decision about the reliability of a route segment without delay.

A decision method which has a simple combinatory logic and which simulates the possible sequences of the train journeys requires a very large number of working steps. The trains and the track topology have to be taken into account completely in such a method.

Given n trains with a route length of m route segments each, a computational expenditure of the order of magnitude of $n^{m \times n}$ process steps is necessary.

SUMMARY OF THE INVENTION

It is accordingly an object of the invention to provide a congestion prevention system and method, which overcome the above-mentioned disadvantages of the heretofore-known devices and methods of this general type and which provides a method which detects, with a smaller degree of computational expenditure, possible congestion, i.e., overfilling, before route segments are securely set up in terms of signaling equipment.

With the foregoing and other objects in view there is provided, in accordance with the invention, and in the context of a track system organized with track sectors and having a route level with routes and a switchgear level with route segments, the route level and the switchgear level being coupled for requesting a setting of a route segment and to signal train positions, a congestion prevention method for preventing an overfilling of the track system. The novel method comprises the following steps:

defining train positions of trains on the track system with a train identifier and a track sector; and prior to setting a requested route segment for a given train, querying the route level to determine, by checking train positions, whether the given train is allowed to travel on the track sectors to be used for the requested route segment, without the track system becoming congested.

The method according to the invention has the following advantages, inter alia:

In the track system which is to be protected against overfilling, the automatic setting up of route segments is permitted only if the track system is not overfilled as a result, i.e. all the trains can reach their programmed destination.

The method according to the invention indirectly contributes to the safety of the railway traffic in that unusual maneuvers for disentangling trains are avoided.

The small number of working steps required to assess the situation permits the use of the method in control systems in a relatively large track system to be protected without disadvantageous effects on the prompt setting up of the route segments.

In accordance with an added feature of the invention, the step of checking a train position comprises the following substeps, to be performed in the route level:

a) storing a first dependency according to which a new train position cannot be reached until the train has reached a track sector that directly precedes the route, the first dependency being defined as a compulsory sequence of two train positions;

b) checking, for a variation of two trains, whether a reference location of a first train prevents the route of a second train being traveled on resulting in a second dependency, and storing the second dependency;

c1) generating, for all the trains, new dependencies by applying a transitivity from the stored dependencies, and storing the new dependencies; and c2) checking the new dependencies whether a compulsory sequence according to which the first train must travel to a first track sector before the second train can travel to a second track sector.

In accordance with an additional feature of the invention, steps c1) and c2) are repeatedly executed for all trains until no further new dependencies can be generated or until no train can reach a destination predefined by its route.

In accordance with another feature of the invention, there is located a reference location of a train with respect to another train between a signaled position and a next controlling track sector on a route thereof, and defining a controlling track sector as a start of a route segment requested from the route level.

In accordance with a further feature of the invention, the method comprises:

carrying out step a) for all the trains; and carrying out step b) for all possible variations of two trains.

In accordance with again an added feature of the invention, the method comprises:

storing timetable dependencies of the trains and predefined train sequences as dependencies; and inserting the stored dependencies for the respective trains before performing step c).

With the above and other objects in view there is also provided, in accordance with the invention, a congestion prevention system for preventing an overfilling of the track system. The congestion prevention system comprises:

a process module containing means for querying the route level to determine train positions in the track system, and upon receiving a request for setting a given route segment for a given train, to determine whether the given train is allowed to travel on the track sectors to be used for the requested route segment, without causing the track system to become congested.

In accordance with yet an added feature of the invention, the process module, for checking the train positions in/the route level, contains:

a first sequence module for storing a dependency according to which a new train position cannot be reached until the train has reached a directly preceding track sector on the route, the dependency being defined as a compulsory sequence of two train positions;

a relation module for checking for two trains whether a reference location of a first train prevents the route of a second train from being traveled on and for storing a result as a dependency;

a transitivity module for generating and storing new dependencies by applying a transitivity from stored dependencies; and a second sequence module connected to the transitivity module for checking whether there is a compulsory sequence according to which the first train must travel to a first track sector before the second train is allowed to travel to the second track sector.

In accordance with yet an additional feature of the invention, there is provided an iteration module, superordinate to the transitivity module and the second sequence module, for repeatedly carrying out an iteration for all the trains until no further new dependencies can be generated or until no train can reach the destination predefined by its route.

In accordance with yet another feature of the invention, the reference location is defined in the relation module, according to which the reference location of a train with respect to another train is located between the signaled position and the next controlling track sector on a route thereof, and a controlling track sector is defined as the start of a route segment requested from the route level.

In accordance with yet a further feature of the invention, the system includes a second iteration module, superordinate to the first sequence module, for carrying out an iteration for all the trains, and a third iteration module, superordinate to the relation module, for carrying out an iteration for all the variations of two trains.

In accordance with a concomitant feature of the invention, there is provided a data module that stores timetable dependencies of trains and predefined train sequences as dependencies, and a deployment module that inserts the stored dependencies for respective trains and feeds the stored dependencies to the transitivity module.

Other features which are considered as characteristic for the invention are set forth in the appended claims.

Although the invention is illustrated and described herein as embodied in a method and a system for preventing overfilling of a track system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Before delving into the specifics of the exemplary embodiments of the invention, the following provides a list of specific terms used herein and their definitions.

A "route segment" is the smallest unit of a route which is protected by a signal tower or switchgear unit and which can be set up for a train.

A "track sector" (also referred to as a track field) is the starting point or destination point of a route segment.

A "controlling track sector" is a track area at a start of a route segment that is requested by the track control system.

A "track system" is a configuration of track sectors.

A "route" (also referred to as an itinerary) is route of a train through a track system over successive track sectors.

A "setup request" is an inquiry by the track control system to an congestion prevention system as to whether a specific route segment can be set up.

A "request" is a request for setting up a route segment order from the track control system to the signal tower equipment, that is, to the switchgear system.

"Congestion" of a track system (also referred to as overfilling) occurs in the track system if trains obstruct each other's routes in such a way that at least one train cannot reach its destination on its programmed route, that is, according to its itinerary.

The congestion prevention system, referred to below by the acronym "CPS", as part of the train control system decides on the setting up of a route segment after the arrival of the setup request. For this purpose, the method according to the invention supplies, as part of the CPS, the indication of which trains can reach their programmed destination.

Figure 1:
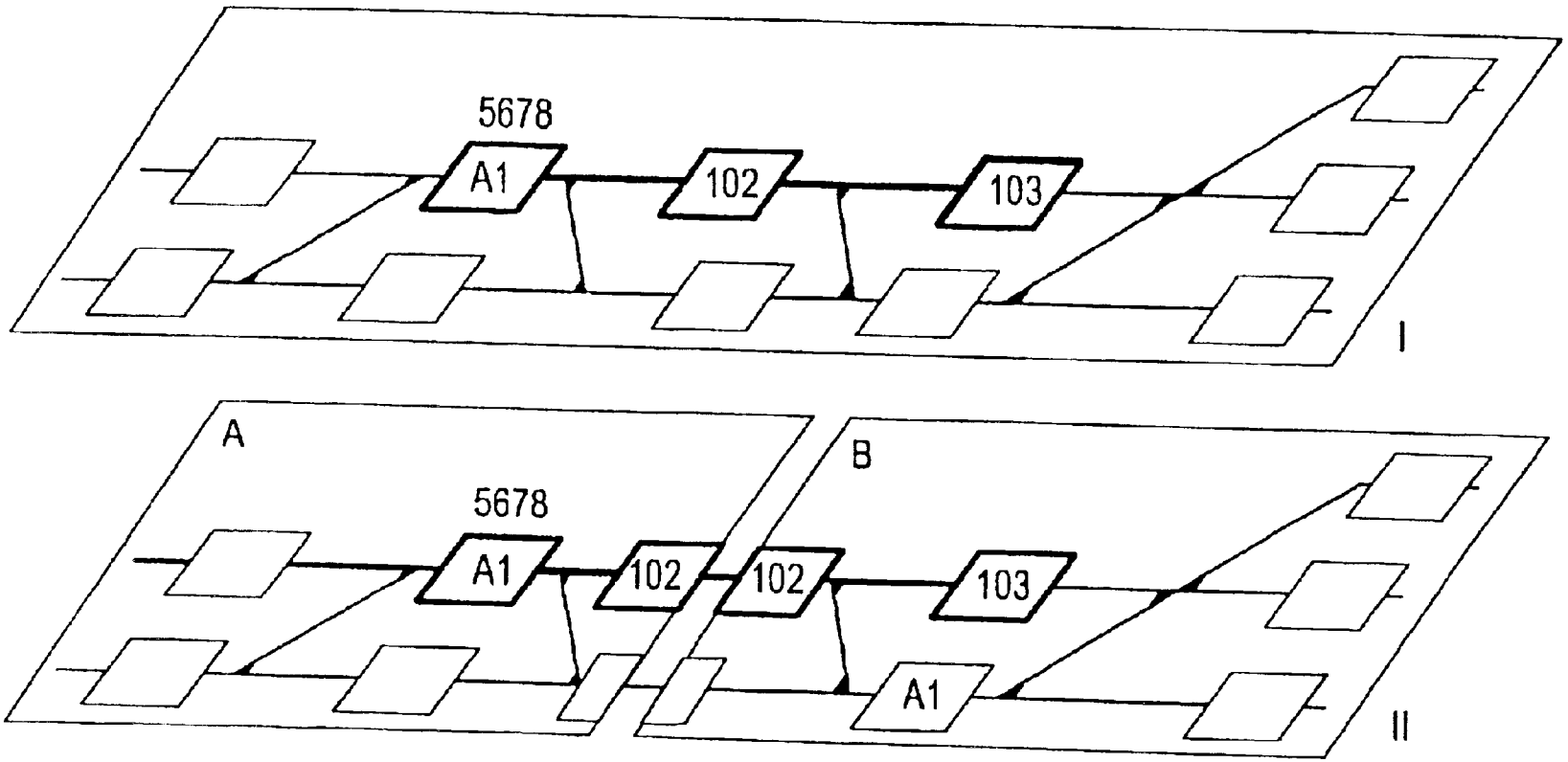
FIG. 1 is a diagrammatic perspective view of a track system with a route level I and a switchgear level (signal tower level) II.
Figure 2:
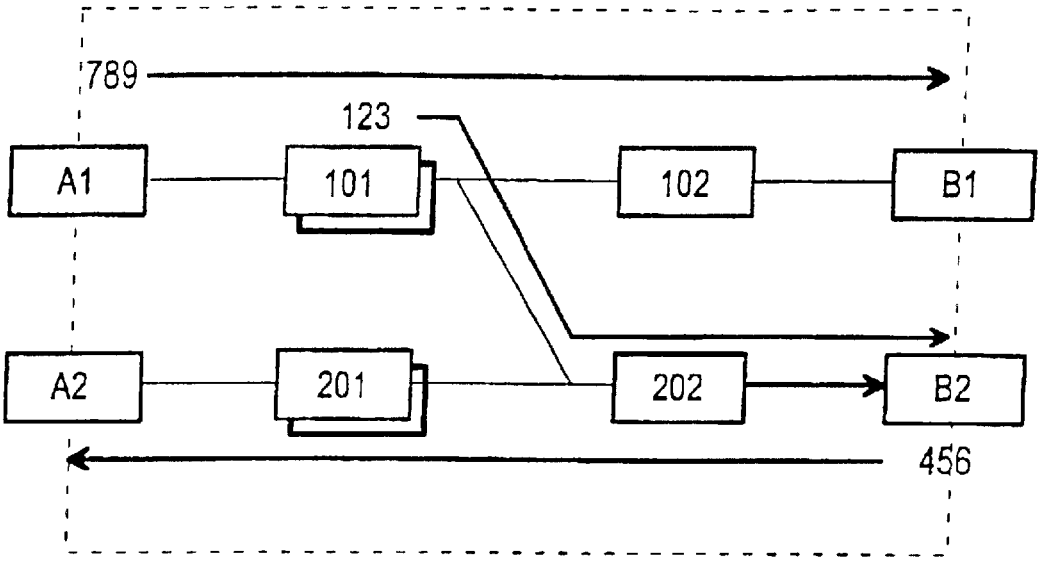
FIG. 2 is a block diagram showing an example of a congestion prevention system (CPS) area with three trains.

The behavior of the congestion prevention system and the embedding of the method according to the invention into the CPS are explained below with reference to FIG. 2. In FIG. 2, the track system to be monitored, what is referred to as an overfilling area, is illustrated with a rectangle which is represented by dashed lines.

The location of the trains with the train numbers ZN 123, ZN 456 and ZN 789:

ZN(123) 101

ZN(456) B2

ZN(789) A1

Routes

ZN(123) 101-202-B2

ZN(456) B2-202-201-A2

ZN(789) A1-101-102-B1

A setup request for ZN(123) from 101 to 202 is signaled to the CPS.

The result of the method with the setup request for ZN(123) is:

ZN(123) and ZN(456) can no longer reach their destination.

Decision of the CPS

The setting up of the route segment for ZN(123) is not permitted.

A setup request for ZN(789) from the track sector A1 to the track sector 101 is signaled to the CPS.

The result of the method with the setup request for ZN(789) is:

All the trains can reach their destination.

Decision of the CPS

The CPS permits the setting up of the route segment for the train ZN(789).

For signaling equipment reasons, the route segment is not implemented.

A setup request for ZN(456) from the track sector B2 to the track sector 202 is signaled to the CPS.

The result of the method with the setup request for ZN(456) is:

All the trains can reach their destination.

Decision of the CPS

The CPS permits the setting up of the route segment for ZN(456).

As soon as the route segment is implemented, the CPS reevaluates the situation.

The result of the method with the setup request for ZN(123) is:

All the trains can reach their destination.

Decision of the CPS

The CPS permits the setting up of the route segment for ZN(123).

Figure 5:
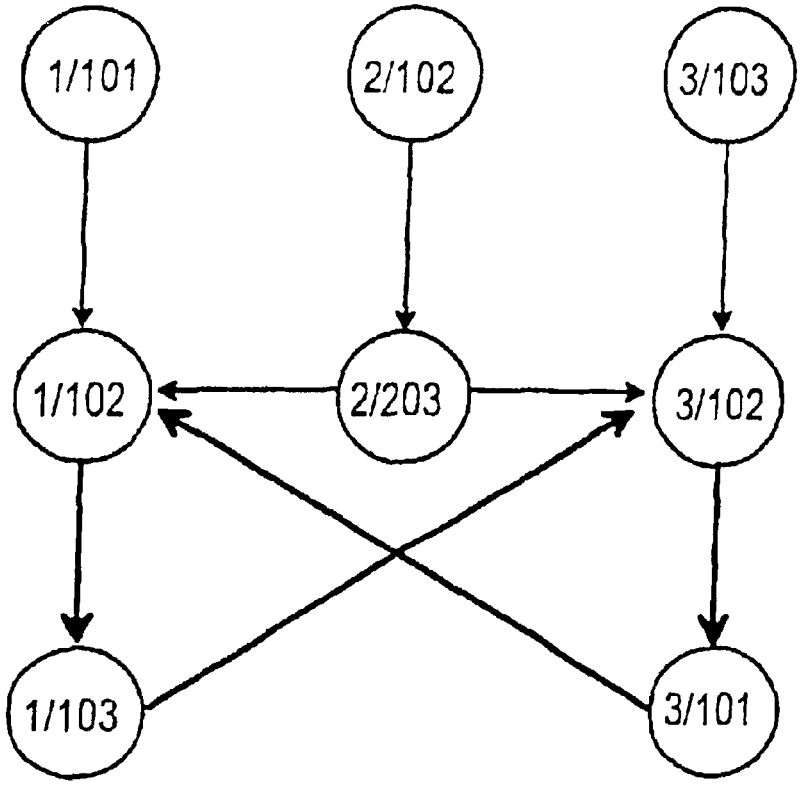
FIG. 5 is a graphic representation of dependencies.

After this explanation, there is then a formal description of the method according to the invention. Whether a train reaches its destination depends on the position and the routes of other trains. The dependencies are described in this algorithm with a graph represented in FIG. 5 or formally in the following notation:

A current train position, or a train position to be reached, is represented by an ordered pair containing the train number and track sector:

Train number/track sector.

A dependence of two train positions is expressed by a relation symbol:

X/103→Y/102.

The semantics of this notation X/103→Y/102 stand for:

There is a compulsory sequence, whether of a commercial or deployment type or of a type relating to the prevention of overfilling, that a first train X must travel to the track sector 103 before a second train Y can travel to the track sector 102.

The notation and semantics which are introduced above are also appropriate for the case X=Y, for example for the train ZN(789) in FIG. 2: 789/101→789/102.

This introduced relation is transitive: if train X has to be routed to A before train Y can travel onward to B, and if train Y has to be routed to B before train Z can travel onward to C, then train X must be routed to A before train Z can travel onward to C. Using the notation just introduced, the following is obtained:

X/A→Y/B and Y/B→Z/C⇒X/A→Z/C. The symbol⇒stands for an implication. This dependence can also be written as:

X/A→Y/B→Z/C.

If the case X/A→Y/B→ . . . →X/A occurs, this results in that the train X must first be routed onward to A before train Y can be routed onward to B. In this way, a blockage in the CPS area to be checked becomes apparent. In an associated graph of the type according to FIG. 5, a cycle occurs.

Figure 3:
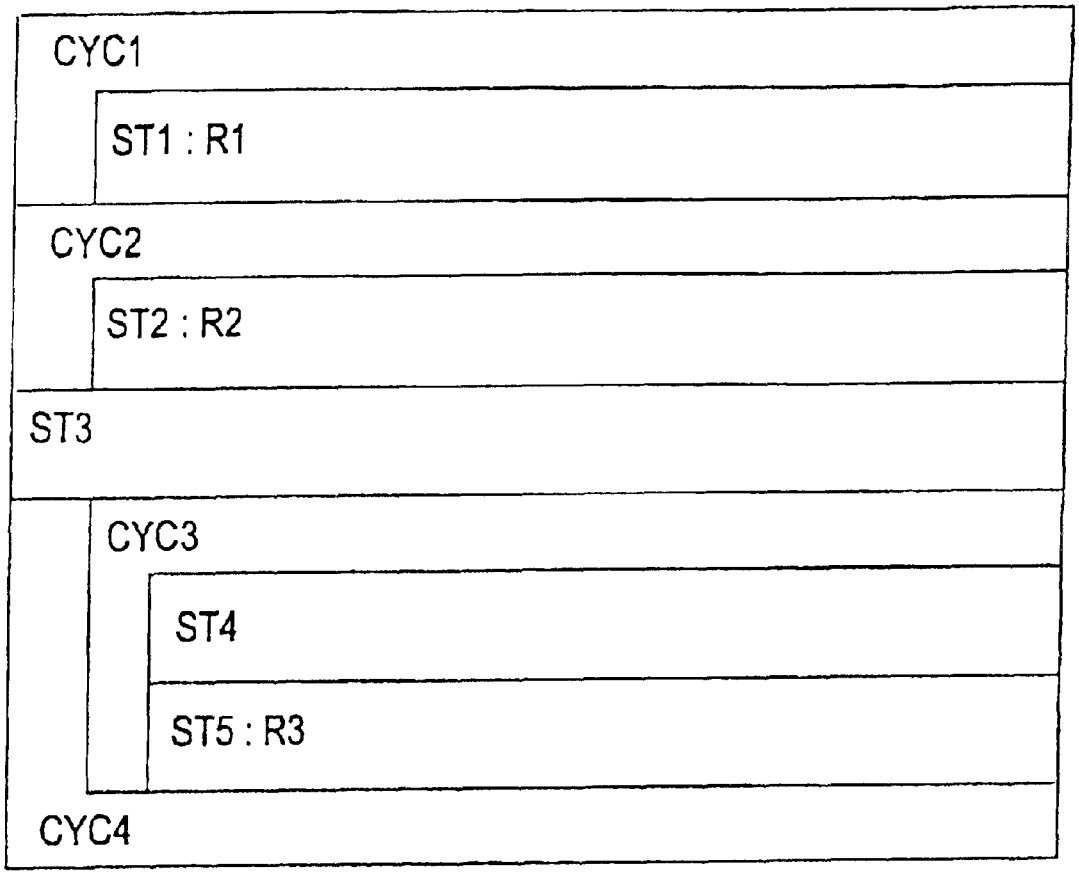
FIG. 3 is a structogram showing a method according to the invention for preventing overfilling.

The method according to the invention is preferably implemented with the structogram given in FIG. 3. The signaling of train numbers and track sector occupation to the route level is carried out according to prior art solutions, as specified for example in Swiss Patent CH PS 613 419. The method rules (referred to below simply as "rule") specified by use of R1, R2 and R3 in FIG. 3 are as follows:

Rule 1

Before a train Z1 can travel to a track sector G2, it must reach a track sector G1 that is directly preceding on the route (commercial request).

Rule 2

The train Z1 whose reference location with respect to another train Z2 prevents the route of the train Z2 being traveled on leads to additional dependencies.

Track sector A designates the destination of the first route segment on the programmed route of the train Z2 which cannot be implemented owing to train Z1.

Track sector B designates the first position of train Z1 at which the destination of the first route segment on the programmed route of train Z2 which cannot be implemented because of train Z1 is no longer track sector A.

Track sector C designates the first position of train Z1 at which all the route segments of train Z2 could be implemented.

Rule 2a—If the track sector B corresponds to the track sector C, train Z1 must first travel to track sector B before train Z2 can travel to track sector A (operational requirement).

Rule 2b—If the track sector B does not correspond to the track sector C and if all the route segments of the route from train Z2 to track sector A could be implemented if train Z1 were to be switched onward to track sector B, train Z1 must first travel to track sector B before train Z2 can travel to track sector A (operational requirement). Rule 2 must be applied once more, with track sector B as the reference location of train Z1.

Rule 2c—If the track sector B does not correspond to the track sector C and if it would not be possible to implement all the route segments of the route from train Z2 to track sector A if train Z1 were to be switched onward to track sector B, train Z1 must travel to track sector C before train Z2 can travel into the first track sector in which train Z2 prevents the implementation of at least one route segment on the route from the current position of train Z1 to track sector C (overfilling-preventing requirement).

The reference location of a train Z1 with respect to another train Z2 is located between the signaled position and the next controlling track sector on its route.

If the train Z1 is located at a controlling track sector and has not signaled a setup request, the reference location corresponds to the train position.

The reference location is determined as follows:

A. if train Z2 has signaled a setup request whose route segment could be implemented, the destination of the route segment is considered to be a train position for the further working steps;

B. if train Z1 has signaled a setup request whose route could be implemented, the destination of the route segment is considered to be a train position for the further working steps;

C. if the position of train Z1 is a controlling track sector, the reference location corresponds to the train position;

D. if the position of train Z1 is a non-controlling track sector and it prevents the route being traveled on by train Z2, the reference location corresponds to the train position;

E. if the position of train Z1 is a non-controlling track sector, does not prevent the route being traveled on by train Z2 and the route segment to the next destination on the programmed route cannot be implemented because of train Z2, the reference location corresponds to the train position; and F. otherwise, the next track sector on the programmed route is considered to be the train position for the further working steps and the system is continued at number 3 above.

Rule 3

If there is a compulsory sequence that the first train Z1 must travel to the track sector A before train Z2 can travel to the track sector B, and if train Z1 in the track sector A prevents the implementation of at least one route segment on the route from the current train position of train Z2 to the track sector B, then train Z1 must travel into the first track sector after the track sector A on its programmed route, in which first track sector it no longer prevents the route being traveled on from the actual position of train Z2 to the track sector B (operational requirement).

The iterations and method steps indicated in FIG. 3 are explained below. The term variation which is specified below stands here for a configuration of m=2 elements of a set of n elements taking into account the sequence. The calculation of the number of variations is carried out according to $V_n^m = n!/(n-m)!$.

CYC1: Iteration for all Trains:

ST1:R1: Insert and store dependencies according to Rule 1.

CYC2: Iteration for all Variations of Two Trains Z1, Z2:

ST2:R2 Insert and store relations according to Rule 2.

ST3: Take into account deployment dependencies, for example timetabled connections and programmed train sequences.

CYC3: Iteration for all Trains:

ST4: Generate and store dependencies by applying transitivity.

ST5:R3 Insert and store dependencies produced according to Rule 3.

CYC4: Iteration until no further dependencies are added or no train can reach its destination.

A congestion prevention system for preventing overfilling of a track system that is divided into track sectors is divided into modules. The train control system assigned to a route level I contains a congestion prevention module, which itself has a process module. The process module is divided into:

a) a first sequence module which contains an implementation of Rule 1;

b) a relation module which contains an implementation of Rule 2;

c1) a transitivity module which contains an implementation of the transitivity of train positions, according to the notation X/A→Y/B and Y/B→Z/C⇒X/A→Z/C introduced above; and c2) a second sequence module which contains an implementation of Rule 3.

In a particular embodiment, it is possible to superimpose on the transitivity module and the second sequence module an iteration module which repeatedly carries out an iteration for all the trains until no further new dependencies can be generated or until no train can reach the destination predefined by its route. Likewise, it is possible to superimpose on the first sequence module a second iteration module which contains an implementation of the iteration CYC1. In addition, it is possible to superimpose on the relation module a third iteration module which contains an implementation of the iteration CYC2.

The timetable dependencies or specific predefined train sequences—referred to as deployments—are stored in a data module corresponding to the notation given above.

A deployment module contains an implementation of the method step ST3.

The method according to the invention will be explained by reference to FIG. 4 with three trains 1, 2 and 3:

Location of the Trains

ZN(1) 101

ZN(2) 102

ZN(3) 103

Routes

ZN(1) 101-102-103

ZN(2) 102-203

ZN(3) 103-102-101

The three routes lead to the following train positions:

1/101 2/102 3/103 current train positions;

1/102 2/203 3/102 train positions to be reached; and

1/103 3/101 train positions to be reached.

An application of the Rule 1 for the step ST1:R1 yields:

1/101→1/102; 1/102→1/103;

2/102→2/203; and

3/103→3/102; 3/102→3/101.

Six variations are obtained for CYC2. An application of the Rule 2 yields the following dependencies for the step ST2:R2, two of the six variations leading to no dependencies:

Train 2—Train 1:

Rule 2a): 2/203→1/102

Train 3—Train 1:

Rule 2c): 3/101→1/102

Train 1—Train 3:

Rule 2c): 1/103→3/102

Train 2—Train 3:

Rule 2a): 2/203→3/102

Step ST3 does not yield any new dependencies in this example.

CYC4: In the present case according to FIG. 4, no new dependencies arise from the step ST5:R3 and the iteration is exited.

Figure 4:
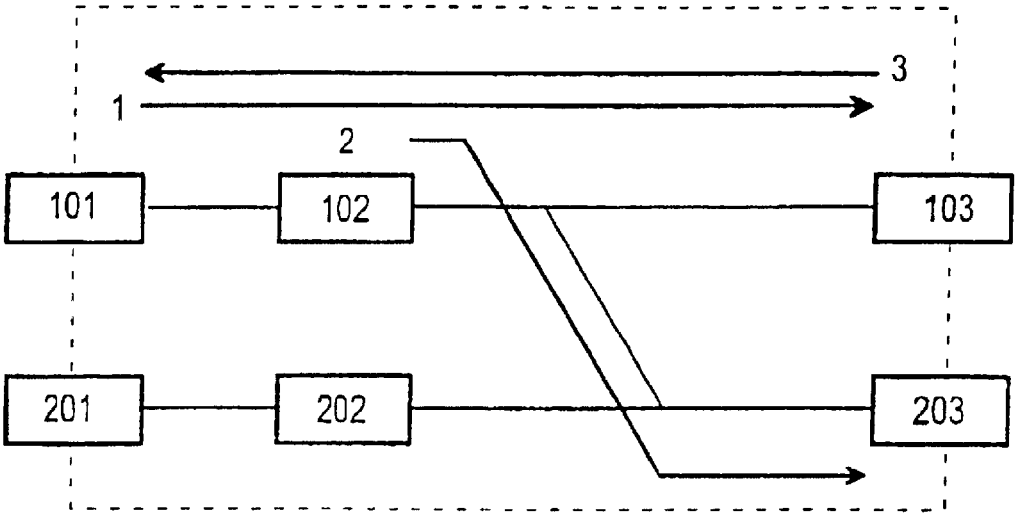
FIG. 4 is a block diagram showing an example of a CPS area with three trains in order to explain method rules.

The result can be seen in FIG. 4: train 1 and train 3 cannot reach their destination. Train 2 can reach its destination.

Figure 6:
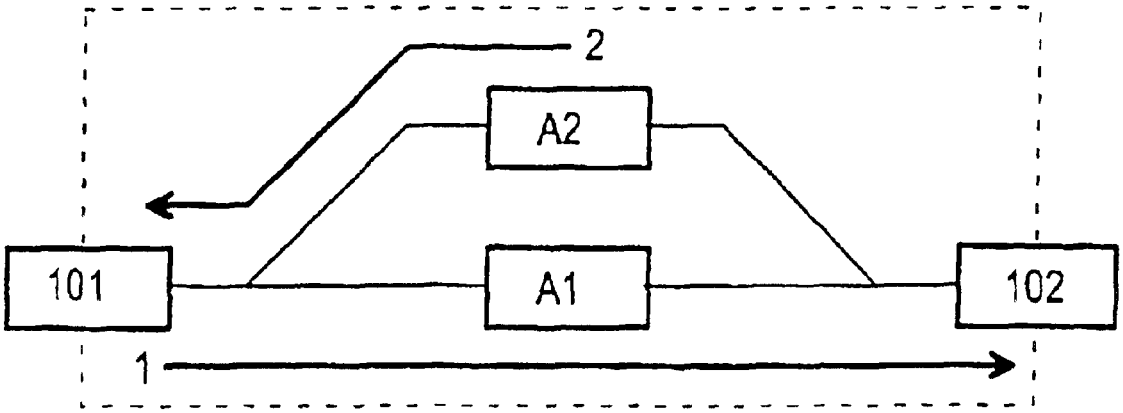
FIG. 6 is a block diagram of an example of a CPS area that contains excessively short track sectors.

FIG. 6 is formally based on the case of excessively long trains or excessively short track sectors. It is assumed that a track sector A2 is too short to completely accommodate the train 2. This results in that a train that has traveled in from the track sector 102 to the track sector A2 prevents a train in track sector A1 moving out to the right.

Location of the Trains

ZN(1) 101

ZN(2) A2

Routes

ZN(1) 101-A1-102

ZN(2) 102-A2-101

According to Rule 2a), the dependence comes about that train 2 must first travel to 101 before train 1 can be released to 102. According to Rules 1 and 2, the following dependencies are produced:

1/101→1/A1→1/102

2/A2→2/101

1/A1→2/101

2/101→1/102

In this case, according to Rule 3 no new dependencies are produced.

Result: train 1 and train 2 can reach their destination.

Figure 7:
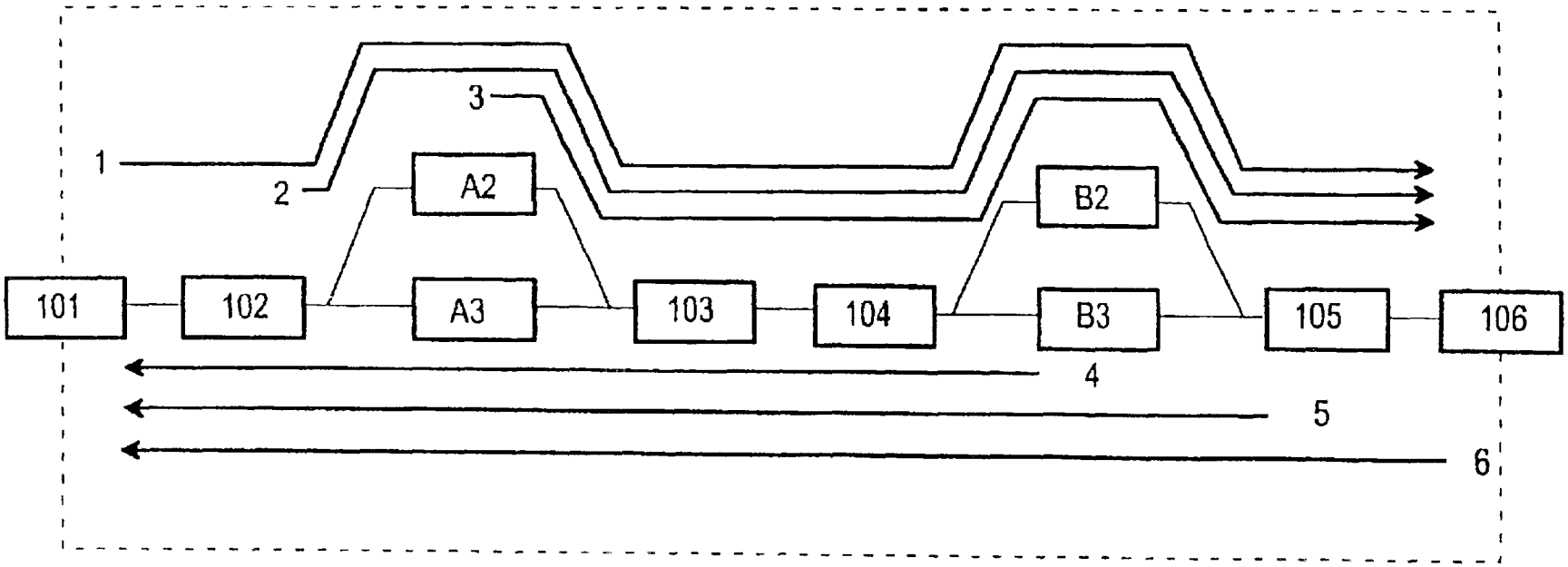
FIG. 7 is a block diagram of an example of a CPS area in which in each case three trains approach two passing stations from each side on a single-track section.

All three rules are applied only in relatively complex initial situations. In this respect the following example is given, but is explained using the rules only to the extent that the invention can be implemented. In each case three trains are traveling on a single-track section from both sides toward two passing stations, in this respect see the configuration according to FIG. 7.

Location of the Trains

ZN(1) 101

ZN(2) 102

ZN(3) A2

ZN(4) B3

ZN(5) 105

ZN(6) 106

Routes

ZN(1) 101-102-A2-103-104-B2-105-106

ZN(2) 101-A2-103-104-B2-105-106 (*)

ZN(3) A2-103-104-B2-105-106

ZN(4) B3-104-103-A3-102-101 (**)

ZN(5) 105-B3-104-103-A3-102-101

ZN(6) 106-105-B3-104-103-A3-102-101

The application of Rule 1 is not represented here.

Rule 2 Yields Inter Alia

2/103→1/A2 (***)

1/A2→4/102

5/104→6/B3

6/B3→3/105

3/105→2/B2

4/102→5/A3

The dependency 2/103→1/A2 according to line (***) is produced as follows: the blocking of ZN(1) by ZN(2) leads, according to Rule 2, to dependencies:

Train Z1=ZN(2), train Z2=ZN(1)

The reference location of Z1 with respect to Z2 is track sector 102.

Z2 cannot reach the track sector 102 because of Z1; from which it follows that:

Track sector A=102 see line (*) in this respect.

Only when Z1 is in track sector A2 can the first route segment be set up by Z2 (101-102); from this there follows:

Track sector B=A2.

Only if Z1 has exited the track system to be protected can all the route segments be set up by Z2; from this there follows:

Track sector C=106.

As track sector B does not correspond to track sector C, and Z2 can travel to track sector A if Z2 is in track sector B, Rule 2b comes into force.

This yields the result given in the line (***).

The Transitivity Yields

2/103→1/A2 and 1/A2→4/102 leads to 2/103→4/102.

According to Rule 3 the dependence 2/B2→4/102 is produced.

This dependence 2/B2→4/102 results from the dependence 2/103→4/102 as follows:

Train 2 is the first train Z1 according to Rule 3.

Train 4 is the second train Z2 according to Rule 3. Routes for train 2 and train 4:

ZN(2) 102-A2-103-104-B2-105-106 (*)

ZN(4) B3-104-103-A3-102-101 (**)

The track sector 103 prevents the implementation of the route segment 103-A3-102 by train 4 from the route for train 2 in the line designated by (*), in this respect see line (**). Rule 3 then requires, with respect to the first train—train 2 here—that train 2 must first be moved onward to B2; moving onward to track sector 104 is not sufficient as train 2 prevents the implementation of the route segment 104-103-A3-102 by train 4 with the track sector 104, resulting in, as already mentioned above:

2/B2→4/102

The Transitivity Yields

5/104→6/B3 and 6/B3→3/105 leads to 5/104→3/105.

According to Rule 3 the dependence 5/A3→3/105 is produced.

This results in the cycle 3/105→2/B2→4/102→5/A3→3/105. As 2/2B→1/104 and 5/A3→6/103, no train can reach its destination.

Deployment requests can also be handled by the method according to the invention. For a station with the track configuration according to FIG. 6 with sufficiently long track sectors it will be assumed that a timetabled location for changing between trains is provided for two trains traveling in the same direction: the express 1 overtakes a local train 2 and as a result ensures a connection between the trains (these trains are not represented in FIG. 6).

Location of the Trains

ZN(1) A2

ZN(2) 101

Routes

ZN(1) 101-A2-102

ZN(2) 101-A1-102

According to Rule 2 no new dependence is produced. Train 1 can only travel onward to track sector 102 if train 2 has previously traveled into track sector A1; the following deployment dependence is thus produced in the introduced notation:

2/A1→1/102.

According to Rule 3 no new dependence is produced.

Result

Train 1 and train 2 can reach their destination.

Implementations of the Rules 1, 2a–2c and 3 which are based on another structogram according to FIG. 3 are possible.

We claim:

1. In a track system organized with track sectors and having a route level with routes and a switchgear level with route segments, the route level and the switchgear level being coupled for requesting a setting of a route segment and to signal train positions, an overfilling prevention method for preventing an overfilling of the track system, which comprises the following steps:

defining train positions of trains on the track system with a train identifier and a track sector; and prior to setting a requested route segment for a given train, querying the route level to determine, by checking train positions, whether the given train is allowed to travel on the track sectors to be used for the requested route segment, without the track system becoming overfilled;

wherein the step of checking train positions is performed in the route level and comprises the following substeps performed in the route level:

a) storing a first dependency according to which a new train position cannot be reached until the train has reached a track sector that directly precedes the route, the first dependency being defined as a compulsory sequence of two train positions;

b) checking, for a variation of two trains, whether a reference location of a first train prevents the route of a second train being traveled on resulting in a second dependency, and storing the second dependency;

c1) generating, for all the trains, new dependencies by applying a transitivity from the stored dependencies, and storing the new dependencies; and c2) checking the new dependencies whether a compulsory sequence according to which the first train must travel to a first track sector before the second train can travel to a second track sector.

2. The method according to claim 1, which comprises repeatedly executing steps c1) and c2) for all trains until no further new dependencies can be generated or until no train can reach a destination predefined by its route.

3. The method according to claim 1, which comprises locating a reference location of a train with respect to another train between a signaled position and a next controlling track sector on a route thereof, and defining a controlling track sector as a start of a route segment requested from the route level.

4. The method according to claim 1, which comprises:

carrying out step a) for all the trains; and carrying out step b) for all possible variations of two trains.

5. The method according to claim 1, which comprises:

storing timetable dependencies of the trains and predefined train sequences as dependencies; and inserting the stored dependencies for the respective trains before performing step c).

6. In a railway track system organized in track sectors and having level models including a route level defining routes and a switchgear level defining route segments, and wherein the level models are coupled for purposes of requesting a setting of a route segment and signaling a train position, and a train position is defined by a train identifier identifying a train and a track sector, an overfilling prevention system for preventing an overfilling of the track system, the overfilling prevention system comprising:

a process module containing means for querying the route level to determine train positions in the track system, and upon receiving a request for setting a given route segment for a given train, to determine whether the given train is allowed to travel on the track sectors to be used for the requested route segment, without causing the track system to become overfilled;

said process module, for checking the train positions in the route level, containing:

a first sequence module for storing a dependency according to which a new train position cannot be reached until the train has reached a directly preceding track sector on the route, the dependency being defined as a compulsory sequence of two train positions;

a relation module for checking for two trains whether a reference location of a first train prevents the route of a second train from being traveled on and for storing a result as a dependency;

a transitivity module for generating and storing new dependencies by applying a transitivity from stored dependencies; and a second sequence module connected to said transitivity module for checking whether there is a compulsory sequence according to which the first train must travel to a first track sector before the second train is allowed to travel to the second track sector.

7. The system according to claim 6, which comprises an iteration module, superordinate to the transitivity module and the second sequence module, for repeatedly carrying out an iteration for all the trains until no further new dependencies can be generated or until no train can reach the destination predefined by its route.

8. The system according to claim 6, wherein the reference location is defined in the relation module, according to which the reference location of a train with respect to another train is located between the signaled position and the next controlling track sector on a route thereof, and a controlling track sector is defined as the start of a route segment requested from the route level.

9. The system according to claim 7, wherein said iteration module is a first iteration module and the system further includes a second iteration module, superordinate to said first sequence module, for carrying out an iteration for all the trains, and a third iteration module, superordinate to said relation module, for carrying out an iteration for all the variations of two trains.

10. The system according to claim 6, which comprises a data module storing timetable dependencies of trains and predefined train sequences as dependencies, and a deployment module inserting the stored dependencies for respective trains and feeding the stored dependencies to said transitivity module.

* * * * *